US006039819A

United States Patent [19]

Harrod et al.

[11] Patent Number: 6,039,819

[45] Date of Patent: Mar. 21, 2000

[54] SOLID PROPELLANT CONTAINING FERROCENYL PHOSPHINE DERIVATIVES

[75] Inventors: Charles E. Harrod, Manassas; William D. Stephens, Vienna, both of Va.

[73] Assignee: Atlantic Research Corporation, Gainesville, Va.

[21] Appl. No.: 06/354,709

[22] Filed: Mar. 4, 1982

[51] Int. Cl.[7] ..... C06B 45/10

[52] U.S. Cl. ..... 149/19.2; 149/19.9; 149/19.1

[58] Field of Search ..... 149/19.1, 19.2, 149/19.9

[56] References Cited

U.S. PATENT DOCUMENTS

| | | | |
|---|---|---|---|
| 3,447,981 | 6/1969 | Sayles | 149/19.2 |
| 3,512,932 | 5/1970 | Stern et al. | 149/19.2 |
| 3,755,311 | 8/1973 | Zimmer-Galler | 149/19.2 |
| 3,974,004 | 8/1976 | Cucksee et al. | 149/19.9 |
| 4,019,933 | 4/1977 | Cucksee et al. | 149/19.9 |
| 4,023,994 | 5/1977 | Arendale | 149/19.2 |
| 4,110,135 | 8/1978 | Graham et al. | 149/19.9 |
| 4,133,706 | 1/1979 | Shouts | 149/19.2 |
| 4,318,760 | 3/1982 | Stephens | 149/19.2 |
| 4,352,700 | 10/1982 | Hoffman | 149/19.9 |

*Primary Examiner*—Edward A. Miller
*Attorney, Agent, or Firm*—Nixon & Vanderhye PC; Frank P. Presta

[57] ABSTRACT

A solid propellant composition comprising an organic polymer fuel binder, an inorganic perchlorate oxidizer salt, ferrocenyl phosphine or phosphine oxide derivatives and in particular, triferrocenyl phosphine oxide, which function as stable solid combustion modifiers.

10 Claims, No Drawings

SOLID PROPELLANT CONTAINING FERROCENYL PHOSPHINE DERIVATIVES

The present invention relates to ferrocenyl phosphines or ferrocenyl phosphine oxides as a combustion modifier for solid propellant compositions comprising an organic polymer fuel binder and an inorganic perchlorate oxidizer salt.

The efficacy of ferrocene, a volatile red organometallic solid, as a burning rate accelerator in a solid composite propellant, was discovered in the early 1950's. It was found that ferrocene was superior to the inorganic compounds, such as iron oxide, copper chromite and the like, then in use. Ferrocene, in equivalent amounts, gave much larger increases in burning rate and could be used effectively in increasingly higher concentrations with concomitant increase in burning rate.

Unfortunately, propellants containing ferrocene undergo changes in composition with time due to volatility of the catalyst compound. This results in changes in both mechanical and ballistic properties during storage. Rocket motors containing ferrocene-catalyzed propellant grains were observed to have red needles of ferrocene sublimed and recrystallized on the grain surface.

Efforts were then turned to development of liquid ferrocene derivative catalysts having higher molecular weight and decreased volatility as compared with ferrocene. In addition to reducing the ferrocene volatility problem, the liquids improve processing properties by reducing the total amount of added solids and functioning as a plasticizer. However, two serious difficulties were encountered with the liquid ferrocene derivatives, crystallization and migration.

Crystallization of the liquid at low temperatures increases the solids content of the propellant above the design concentration and can, thereby, adversely affect mechanical properties.

The liquid also tends to diffuse from the propellant into the rubbery materials normally used in making the conventional liners employed with solid rocket propellant grains. This results in embrittlement of the propellant and undesirable modification of ballistic properties adjacent to the interface between the propellant and liner.

In view of these problems with ferrocene and liquid derivatives thereof, efforts have been made to find a solid ferrocene derivative replacement for the highly volatile ferrocene. To be successful, such a compound must meet several essential criteria. It must produce a substantial increase in burning rate of the propellant as compared with the non-catalyzed composition. It must be a stable, substantially non-volatile compound.

It must not adversely affect the physical or ballistic properties of the propellant composition in such terms, for example, as weight loss due to volatilization or decomposition at the environmental temperatures to which the propellant gain will be exposed, including substantially elevated temperatures; migration or diffusion; increase in propellant sensitivity to friction, impact or heat; production of ballistic unpredictability, such as variation in burning rate within the propellant grain; and the like.

A number of solid, relatively stable ferrocene derivatives have been tried as propellant burning rate accelerators. These include, for example, dimethyl polyferrocenyl methylene (DMPFM), a polymer produced by the reaction of ferrocene and acetone; 1,3-diferrocenyl-1-oxo-2 propene; 1,3-diferrocenyl-1,3-propanedione; and benzoyl ferrocene. DMPFM appeared to be one of the more promising solid ferrocene derivatives for use as a catalyst because of its stability per se and minimal adverse effects on propellant stability. However, it has been found to be inadequately effective as a burning rate accelerator. Other solid substantially stable ferrocene derivatives, which have been tried as propellant burning rate catalysts, produce grains having unacceptable physical and/or ballistic properties.

Recent studies involving diferrocenyl ketone as a propellant burning rate catalyst have shown that this compound is not only stable but also substantially increases burning rate without adverse effects on the stability of the propellant. The use of diferrocenyl ketone in a propellant is disclosed and claimed in U.S. patent application Ser. No. 077,438 filed Sep. 20, 1979, entitled "Solid Propellant Containing Differrocenyl Ketone", now U.S. Pat. No. 4,318,760.

Ferrocenyl phosphine derivatives are a known class of chemical compounds. They have not, however, been used or suggested for use as propellant burning rate catalysts. Like diferrocenyl ketone, many of the ferrocenyl phosphine derivatives of the present invention are high melting, oxidatively stable, non-volatile solids ideally suited for use as solid ferrocene burning rate catalysts. However, triferrocenyl phosphine oxide is far superior to diferrocenyl ketone in that higher burning rates for a given amount of material are achieved. In addition, propellants containing ferrocenyl phosphines are more easily processed than propellants containing an equal amount of other solid ferrocenes.

The present invention now provides a solid propellant composition, comprising an organic polymer fuel binder, an inorganic perchlorate oxidizer salt, and, as a burning rate accelerator, a solid ferrocenyl phosphine or phosphine oxide of the formula $$R_{3-n}\,PR'_n$$

or $$R_{3-n}\,P(O)R'_n$$

wherein R is alkyl, cycloalkyl, aryl or substituted aryl,

R' is ferrocenyl and n is 1 to 3.

The ferrocenyl phosphines or phosphine oxides are oxidatively stable solid compounds. When incorporated into a composite propellant comprising a synthetic organic polymer fuel, and an inorganic perchlorate salt oxidizer, they improve the ballistic performance of the propellant by increasing burning rate and reducing the pressure exponent. These desired results are achieved without adversely affecting the physical or ballistic properties of the propellant. These compounds, which are substantially non-volatile and insoluble in the propellant matrix, exhibit no appreciable tendency to evaporate, sublime or volatalize, or to diffuse or migrate into propellant liner or insulation systems. Neither the ferrocenyl phosphine compounds or the propellant composition show phase change or decomposition over the useful temperature operating range of the propellant. Thus, use of ferrocenyl phosphine derivatives as ballistic modifiers achieves the desired improvement in burning rate and pressure exponent without undesirable catalyst migration or other adverse effect on propellant properties.

Useful ferrocenyl phosphines and phosphine oxides are set forth in Table 1 below. Particularly preferred, are those compounds that have a melting point above 200° C., such as $1,1^1$-bis(diphenyl phosphino)-ferrocene, diferrocenylphenyl phosphine and triferrocenyl phosphine oxide.

TABLE 1

| Compound | Formula | R | R' | n |
|---|---|---|---|---|
| | | Compound Of Formula (A) $R_{3-n}PR'_n$ or (B) $R_{3-n}P(O)R'_n$ | | |
| 1 | A | $CH_3$ | ferrocenyl | 1 |
| 2 | B | $CH_3$ | ferrocenyl | 2 |
| 3 | A | cyclopentyl | ferrocenyl | 1 |
| 4 | B | cyclohexyl | ferrocenyl | 1 |
| 5 | A | phenyl | ferrocenyl | 1 |
| 6 | A | phenyl | ferrocenyl | 2 |
| 7 | B | — | ferrocenyl | 3 |
| 8 | B | — | ethyl ferrocenyl | 3 |
| 9 | A | propyl | ferrocenyl | 1 |
| 10 | A | o-tolyl | ferrocenyl | 2 |
| 11 | A | p-nitrophenyl | ferrocenyl | 2 |

Preferably R is alkyl of 1 to 6 carbon atoms, cycloalkyl of 3 to 6 carbon atoms, naphthyl or phenyl. As an alternate embodiment, substituted ferrocenyls may be used for R', as exemplified in compound No. 8 in Table 1.

The organic polymer fuel binder useful in the invention can be substantially any such binder employed in the art. It can be, for example, polybutadiene and its derivatives such as hydroxy- or carboxy-substituted polybutadiene, polyurethane, polyethers, polyesters, polybutylenes, and the like. The polymer binder may or may not be plasticized with an organic plasticizer as is well known in the art. The preferred binders are the hydroxy- and carboxy-terminated polybutadienes. Since the use, processing, and cure of such binders are well known, they will not be discussed here.

The inorganic perchlorate oxidizer salt can be, for example, the alkali metal, e.g., Na, K, Li; alkaline earth metal, e.g., Ca, Mg; or ammonium salts. Ammonium perchlorate is preferred.

Finely-divided metal fuels, such as Al, Mg, Zr, or the like, may be added for high energy, high performance propellants.

Other additives, conventionally employed in the propellant art, can also be incorporated. These include, for example: cure catalysts to shorten cure time of the organic polymer; potlife extenders to extend the like of the precured composition; ballistic additives to modify burning rate at different pressures; and additives to improve physical, shelf life, or processing characteristics of the propellant.

Solid ferrocenyl phosphine derivatives are effective for use in a wide range of propellant compositions—from high-energy to fuel-rich. The amount of the ferrocenyl phosphine or phosphine oxide is in minor proportion and may be as high as about 20 percent, preferably about 10 percent, with a minimum of about 0.1 percent. The specific concentration used is largely determined by the desired increase in burning rate.

The following examples illustrate the efficacy and improved properties of the preferred ferrocenyl phosphine derivatives as compared with state-of-the-are solid ferrocenes and a liquid ferrocene derivative.

EXAMPLE 1

A. A solid propellant was prepared comprising 70 percent ammonium perchlorate (AP), 16 percent powdered aluminum, 2 percent dioctyl adipate plasticizer, 9 percent hydroxyl terminated polybutadiene, 0.5 percent bonding agent and cure catalysts, and 2.5 percent diacetyl ferrocene, a solid ferrocene burning rate catalyst. This propellant had an end-of-mix viscosity of 14 kilopoise, a burning rate of 0.598 in/sec at 1000 psi and a pressure exponent of 0.317.

B. An identical propellant was prepared except for the substitution of 2.5 percent diferrocenyl ketone for diacetyl ferrocene. This propellant hand an end-of-mix viscosity of 12.5 kilopoise, a burning rate of 0.684 in/sec at 1000 psi and a pressure exponent of 0.274.

C. An identical propellant was prepared except for the substitution of 2.5 percent $1,1^1$-Bis(diphenylphosphino) ferrocene for diferrocenyl ketone. This propellant had an end-of-mix viscosity of 7.5 kilopoise, a burning rate of 0.537 in/sec at 1000 psi, and a pressure exponent of 0.311.

D. An identical propellant was made using 2.5 percent diferrocenylphenyl phosphine. This propellant had an end-of-mix viscosity of 6.5 kilopoise, a burning rate of 0.657 in/sec at 1000 psi, and a pressure exponent of 0.338.

E. An identical propellant was made using 2.5 percent triferrocenyl phosphine oxide. This propellant has an end-of-mix viscosity of 10.2 kilopoise, a burning rate of 0.778 in/sec at 1000 psi and a pressure exponent of 0.392.

F. An identical propellant was made using 2.5 percent Catocene, a commonly used liquid ferrocene derivative. This propellant had an end-of-mix viscosity of 1.4 kilopoise, a burning rate of 0.731 in/sec at 1000 psi, and a pressure exponent of 0.328.

EXAMPLE 2

A. A solid propellant was prepared comprising 85.5 percent ammonium perchlorate (AP), 11 percent hydroxy-terminated polybutadiene, 1.5 percent combustion stabilizer additives, and 2 percent Catocene, a liquid ferrocene-derivative burning rate accelerator. This propellant had a burning rate of 1.32 in/sec at 1000 psi and a pressure exponent of 0.430.

EXAMPLE 3

A. A solid fuel rich propellant comprising 37 percent AP, 23 percent carboxy terminated polybutadiene binder, 34 percent polystyrene bead fuel, 1 percent iron oxide, 2 percent combustion stabilizer additive and 2.75 percent Catocene liquid ferrocene burning rate catalyst. This propellant had a burning rate of 0.930 in/sec at 1000 psi.

B. An identical propellant was made except for substitution of the 2.75 percent Catocene by 2.75 percent triferrocenyl phosphine oxide. This propellant had a burning rate of 0.941 in/sec at 1000 psi.

EXAMPLE 4

Samples of $1,1^1$-Bis(diphenylphosphino)ferrocene (m.p. 180° C.), diferrocenylphenyl phosphine (m.p. 194° C.) and triferrocenyl phosphine oxide (m.p. 270° C.) were placed in an oven at 150° F. under a vacuum of less than 10 mm Hg for 24 hours. All three materials demonstrated essentially no weight loss or physical change, thus demonstrating their non-volatility and thermal stability.

While the present invention has been described by specific embodiments thereof, it should not be limited thereto, since obvious modifications will occur to those skilled in the art without departing from the spirit of the invention or the scope of the claims.

What is claimed is:

1. A solid propellant composition, comprising an organic polymer fuel binder, an inorganic perchlorate oxidizer salt, and a minor proportion of solid ferrocenyl phosphine or phosphine oxide burning rate accelerator of the formula.

$$R_{3-n}PR'_n \text{ or } R_{3-n}P(O)R'_n$$

where R is alkyl, cycloalkyl, aryl or substituted aryl,

R' is ferrocenyl or substituted ferrocenyl and n is 1 to 3.

2. The propellant according to claim 1, wherein R is aryl.

3. The propellant according to claim 2, wherein R is phenyl.

4. The propellant according to claim 1, wherein said burning rate accelerator is $1,1^1$-bis(diphenylphosphino) ferrocene.

5. The propellant according to claim 1, wherein said burning rate accelerator is diferrocenylphenyl phosphine.

6. The propellant according to claim 1 wherein said burning rate accelerator is triferrocenyl phosphine oxide.

7. The propellant according to claim 1, wherein said ferrocenyl phosphine or ferrocenyl phosphine oxide is present in an amount of from about 0.1% to about 20%, based on the total weight of the composition.

8. The propellant according to claim 1, in which said perchlorate oxidizer salt is an alkali metal, alkaline earth metal or ammonium salt.

9. The propellant according to claim 8, in which said perchlorate oxidizer salt is ammonium perchlorate.

10. The propellant according to claim 8 or 9, in which said binder is hydroxy-terminated polybutadiene or carboxy-terminated polybutadiene.

* * * * *